US005084906A

United States Patent [19]

Reist

[11] Patent Number: 5,084,906

[45] Date of Patent: Jan. 28, 1992

[54] PROCESS AND APPARATUS FOR COUNTING PRINTED PRODUCTS

[75] Inventor: Walter Reist, Hinwill, Switzerland

[73] Assignee: Ferag AG, Hinwil, Switzerland

[21] Appl. No.: 537,896

[22] Filed: Jun. 13, 1990

[30] Foreign Application Priority Data

Jul. 10, 1989 [CH] Switzerland ..... 02560/89

[51] Int. Cl.[5] ..... G06M 7/06

[52] U.S. Cl. ..... 377/8

[58] Field of Search ..... 377/8

[56] References Cited

U.S. PATENT DOCUMENTS 1,841,711 1/1932 Cannon ..... 377/8

4,539,470 9/1985 Honegger et al. ..... 377/8

4,713,831 12/1987 Morisod ..... 377/8

*Primary Examiner*—John S. Heyman

*Attorney, Agent, or Firm*—Walter C. Farley

[57] ABSTRACT

For counting printed products (D) conveyed in a scale flow, a contact element (K) is moved in the printed product conveying direction at a speed ($v_2$) higher than the conveying speed ($v_1$). Thus, the contact element (K) contacts the trailing edge ($F_k$) of a printed product ($D_k$) and on each contact a counting pulse is emitted and the contact element is subsequently returned to its starting position. This process is cyclically repeated correlated with the average time interval between two succeeding printed products ($D_k$, $D_{k-1}$).

24 Claims, 4 Drawing Sheets

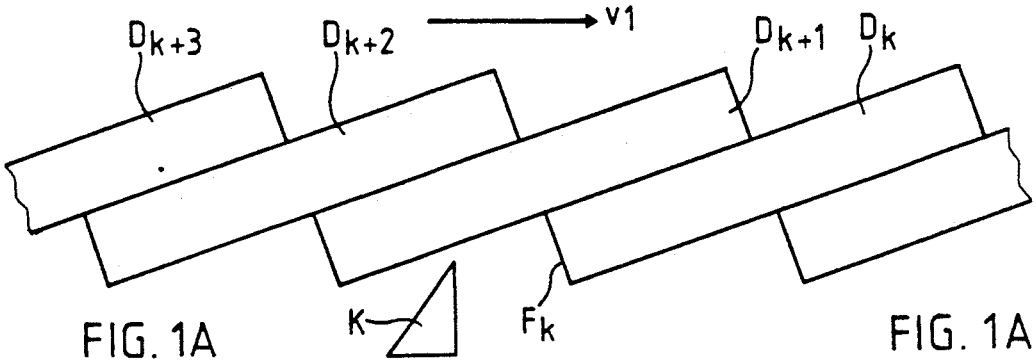
FIG. 1A
FIG. 1A
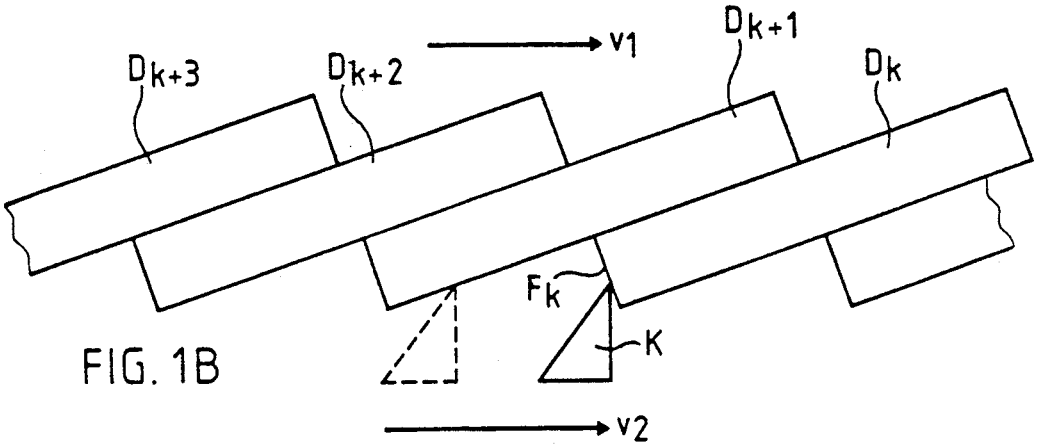
FIG. 1B
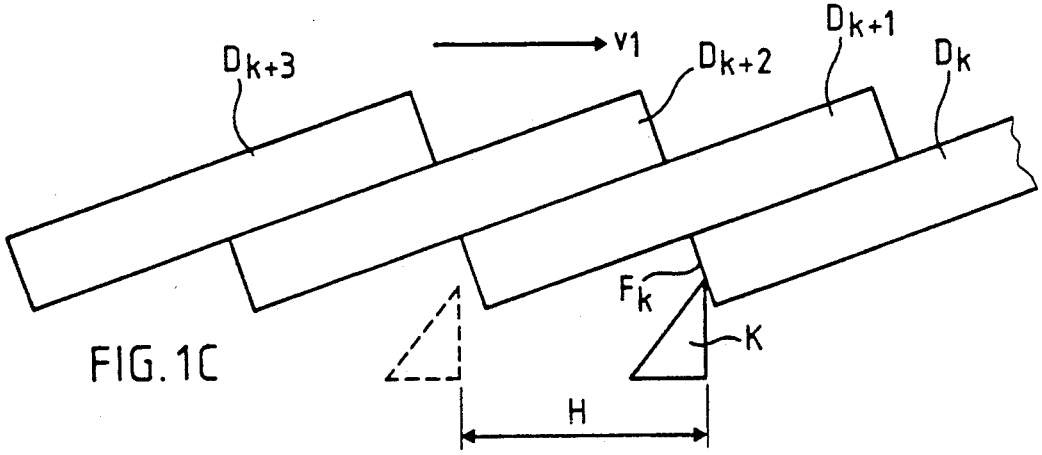
FIG. 1C

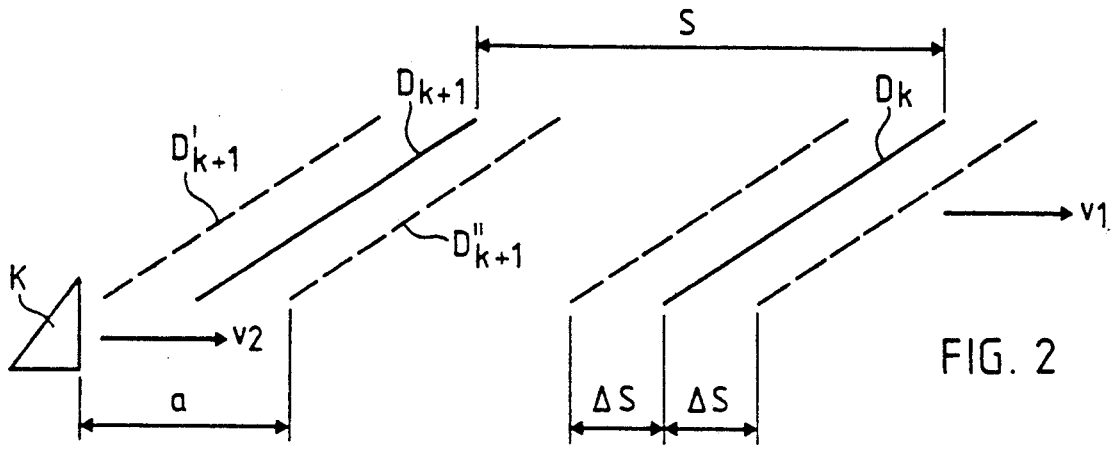
FIG. 2
FIG. 3A
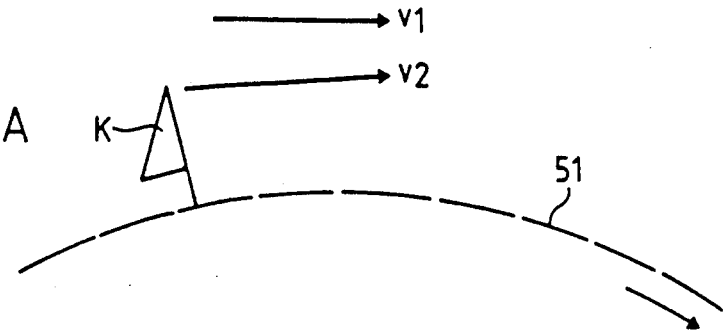
FIG. 3B
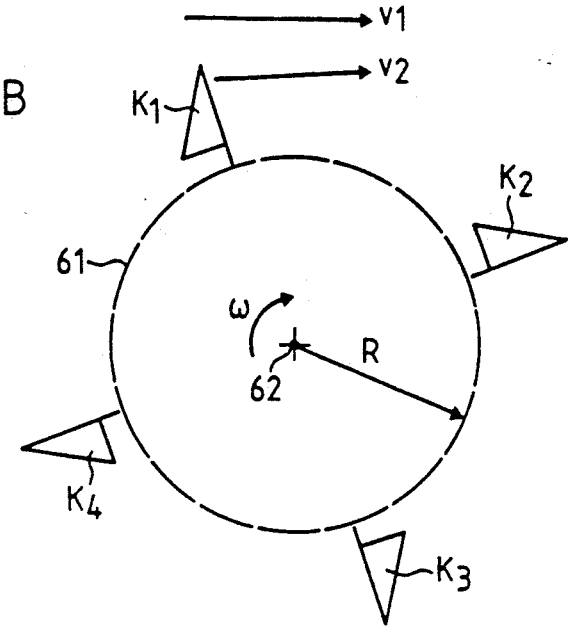

PROCESS AND APPARATUS FOR COUNTING PRINTED PRODUCTS

FIELD OF THE INVENTION

The present invention relates to a process and to an apparatus for producing counting pulses representative of the movement of printed products.

BACKGROUND OF THE INVENTION

In printing works, the printed products from the rotary machine, in particular newspapers and periodicals, are supplied by suitable conveying means to further processing stations (e.g. inserting devices for preliminary and main products, addressing and packaging stations, etc.). In modern, highly automated printing works, where most equipment and sequences are centrally controlled, it is very important to have information at all times and for a large number of strategic points on the number of products which have or have not passed said points (on-line detection and real-time processing of rejects or waste). In view of the high conveying speeds of e.g. 80,000 products per hour, it is also very important to have very precise figures, because even relatively small errors lead in absolute terms to considerable divergences between the actual and the desired quantities and to corresponding economic disadvantages (material losses, superfluous time demands on the printing line and personnel, etc.).

Obviously these needs have already been recognized and numerous processes and apparatuses already exist for counting printed products. One problem which in particular prejudices the measuring accuracy is that the printed products are normally conveyed in a so-called flake or scale flow, i.e. they partly overlap, which makes it much more difficult to recognize, distinguish and determine the individual copies.

Conventional mechanical counting mechanisms generally have a projecting tongue, which is deflected to a certain extent by the upper edges of the printed products conveyed past it and after the passage of the upper edge returns to the inoperative position. The number of deflection movements of said tongue is detected by a counter. The main source of errors for such counting mechanisms is that in the case of printed products, which are provided with a prefold in order to ensure a precisely defined insertion of further printed products, individual printed products, are often counted twice, because the tongue is deflected both by the main fold and also by the prefold. There is also a risk of two or more printed products, which follow one another more closely than they should as a result of an irregularity, cannot be distinguished by the counting mechanism, because the projecting part does not reach its inoperative position between the closely following upper edges. This can also take place if for any reason a printed product projects higher out of the scale flow, so that the movable part is deflected to such an extent that it is no longer deflected by the following printed product. Due to the necessary high pressing pressure between the movable part and the product flow and the resulting friction, incorrect deflection can be caused by even small creases or folds in the printed product. In the case of very thin products, there is a risk of the desired deflection not taking place or at least not being adequate. Although the error rate is often in the 1/1000 range, as stated hereinbefore, it falls beyond the acceptable tolerance limit in high speed processes.

Apart from such mechanical mechanisms, optoelectronic counters are known, which scan the product flow flowing passed e.g. by means of a laser beam and are able to detect the individual printed products on the basis of contrast differences. Quite apart from the fact that the accuracy of such counters can be considerably impaired by marked light/dark differences on the printed product (photographs, etc.), the cost thereof is a particular disadvantage and as a result they are frequently not installed at all the strategically desired points.

It is common to all these known counting mechanisms that they are based on a process, in which the printed products moved passed them are detected at a predetermined, invariable point. However, these statistical counting processes are unable to cope with the constantly varying circumstances of a dynamic process.

SUMMARY OF THE INVENTION

An object of the present invention is to provide a method and an apparatus for obviating these problems.

The advantages of the invention are essentially that the counter is not based on a passive or static principle, but on an active or dynamic principle. The concept is based on the idea that, unlike in the conventional manner, the counting element "acts" and does not merely "react", so that the counting element has its own drive and can adapt to the varying circumstances of the product flow so that the accuracy is considerably increased. Inexpensive constructions are made possible by the simplicity of the system.

BRIEF DESCRIPTION OF THE DRAWINGS

The invention is described in greater detail hereinafter relative to non-limitative embodiments and the attached drawings, wherein:

FIGS. 1A, 1B and 1C are diagrams illustrating the principle of the inventive counting process;

FIG. 2 is a diagrammatic representation of the inventive process;

FIGS. 3A and 3B are schematic side elevations showing two variants of the inventive process;

DESCRIPTION OF THE PREFERRED EMBODIMENTS

Figure 4:
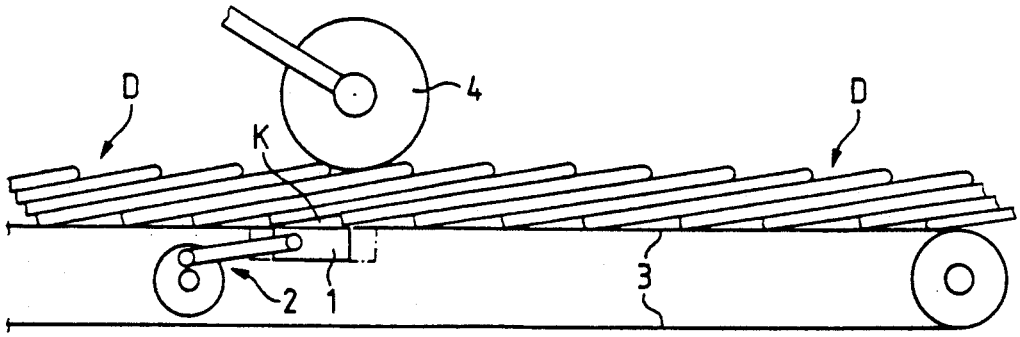
FIG. 4 is a schematic side elevation of a simple apparatus for driving the inventive apparatus.

FIGS. 1A,1B and 1C illustrate the basic idea of the inventive process in a diagrammatic manner. The partially overlapping printed products D supplied in a scale or flake flow are conveyed in the indicated conveying direction at the speed $v_1$, the conveying means not being shown so as not to overburden the drawing. According to the invention, a contact element K, which is shown in its starting position in FIG. 1A, is moved in the same direction at a speed $v_2$, which is higher than the conveying speed $v_1$, preferably in parallel to the scale flow and is brought into contact with the trailing edge or fold $F_k$ of the printed product $D_k$. Suitable means, which will be described in greater detail hereinafter, interprets this contact as a counting pulse and records same by means of a not shown counter (FIG. 1B).

FIG. 1C shows the end position of the contact element K, which is displaced in the conveying direction by a distance H (contact element stroke) with respect to the starting position of FIG. 1A. The contact element is then moved back into its starting position and the counting process recommences.

Unlike in the case of the aforementioned, conventional, mechanical counters, which can be considered as passive counters, the process of the invention is an active counting process, in which the contact element K is not fixed and simply deflected by the printed products moved passed and is instead brought into an appropriate contact with the printed products by an independent movement. Through a corresponding construction of the contact element and the specific circumstances of the control adapted to the product flow to be counted (variation of the forward and rearward speed and at all events the stroke), it is possible to eliminate various error sources and consequently obtain much better measurement results.

The described process will now be further described from the theoretical standpoint by means of FIG. 2. Although the process is not limited to processes taking place in a regular manner, it is subsequently assumed that, as is conventionally the case in high capacity conveying systems, all the actions take place in accordance with a predetermined system clock or timing T (or a fraction or multiple of said clock correlated therewith, in which e.g. T = 1/(number of copies per second)). For the local distance S between two successive printed products $D_k$, $D_{k+1}$ conveyed at speed $v_1$, the following applies:

$$S = v_1 \cdot T \tag{1}$$

The behaviour of the contact element K must also be matched to this system clock. During a working cycle the contact element covers twice the stroke path H. Using the simplifying assumption that the contact element is moved in lag-free manner with a constant average speed $v_2$ during its forward and return travel, then we obtain:

$$2H = v_2 \cdot T \tag{2}$$

It follows from the above equations (1) and (2):

$$v_2/2H = v_1/S \tag{3}$$

In a real system the distance S between two succeeding printed products is subject to statistical fluctuations, which leads to an important error source in conventional counting processes. The broken lines in FIG. 2 diagrammatically show that most of the printed products $D_k$, $D_{k+1}$ are in a band width of $\pm\Delta S$ ($\Delta S$ can e.g. be the standard deviation or average quadratic variance) with respect to the theoretical position (the relations are chosen in an arbitrary manner). In order to ensure that the contact element K also detects a printed product $D'_{k+1}$ set back by $\Delta S$ compared with the theoretical position, the contact element K must be controlled in such a way that its forward movement is initiated with a corresponding time lag with respect to the normal position of the printed product. However, as a result, the contact element has a "lag" a compared with a printed product $D''_{k+1}$ in advance by $\Delta S$ compared with the normal position and which amounts to at least $2\Delta S$ and which it must make up on its forward path in order to be able to detect said printed product. If b is the distance covered by the contact element K on its forward path before it contacts the printed product, it is possible to write:

$$b/v_2 = (b-a)/v_1 \tag{4}$$

Resolved according to the path b, it follows:

$$b = a/(1 - v_1/v_2) \tag{5}$$

In order that the contact element K can catch up with a given printed product, the distance b must be smaller than the stroke H:

$$H \geqq a/(1 - v_1/v_2) \tag{6}$$

Since as stated hereinbefore $a \geqq 2\Delta S$, we also obtain:

$$H \geqq 2\Delta S/(1 - v_1/v_2) \tag{7}$$

As a result of the algebraic conversion of the inequations (3) and (7), for the two system variables H and $v_2$ of the contact element K, the following conditions are obtained:

$$H \geqq S/2 + 2\Delta S \tag{8}$$

$$v_2 \geqq (1 + (4\Delta S)/S) \cdot v_1 \tag{9}$$

It must be stressed that in the case of the above inequations, the speed $v_2$ is only the average speed of the contact element K during its forward and return movement on the stroke path H. It is obviously possible to move the contact element with a non-constant speed. Thus, the contact element can e.g. be advanced at a multiple of the average speed and subsequently be returned at a slower speed. Rest or inoperative phases can be provided both in the starting position and end position of the contact element. In the practical case, the movement of the contact element will tend to be a non-uniformly accelerated movement. In a practical construction, the contact element can immediately return to its starting position after contacting the printed product without completing the entire stroke path, so that as a function of the divergence of the printed product from the normal position, a different contact element movement occurs.

Since, for technical reasons, the contact element speed cannot be chosen at a random high level, in practical terms an average contact element speed $v_2$ has proved satisfactory and this essentially corresponds to twice the product flow speed $v_1$. In this case the stroke H essentially corresponds to the average spacing S of the products in the scale flow.

The above remarks were based on a substantially linear forward and return movement of the contact element. Although this corresponds to the preferred movement in the apparatus construction, the inventive process is obviously not limited to such movement sequences of the contact element. FIG. 3A diagrammatically shows another variant, in which, for reasons of simplicity, the printed products are merely indicated by their linear speed $v_1$. The contact element K is moved on a non-linear (e.g. circular arc or elliptical) path 51 with the average speed $v_2$. This path can be open or closed, so that in the second case the contact element K does not move back again on the same path and instead is always moved in the same direction and can be returned to its starting position by a portion of path 51 not shown in the drawing. This leads to large acceleration differences, which could have a negative effect on the contact element during reciprocating movements and high conveying speeds. Here again, the time cycle of the movement of the contact element K is preferably so coupled with the superimposed system clock T, that the contact element K performs a complete revolution during such a system clock T.

In FIG. 3B several identical contact elements, e.g. $K_1$ to $K_4$ are moved at regular intervals on a circular path 61. They are rotated with the angular velocity $\omega$ about a fixed rotation axis running essentially at right angles to the conveying direction of the printed products. The rotational speed $\omega$ and the radius R of the path 61 are chosen in such a way that the tangential speed $v_2$ of the contact elements $K_1$ to $K_4$ is once again higher than the conveying speed $v_1$ and, relative to a stationary observer, the individual contact elements $K_1$ to $K_4$ once again follow one another in the system clock T.

A description will now be given of preferred counting mechanisms, which are based on the aforementioned process. The mechanisms are in particular based on linearly moved contact elements, but can also be used for other movement paths.

FIG. 4 firstly shows a simple arrangement for the linear drive of the contact element K. The latter is e.g. mounted on a linearly displaceably mounted slide 1, which can be moved forwards and backwards by a crank drive 2 operating in the system clock or timing. The printed products D located on an endless conveyor belt 3 are preferably stabilized by a pressing roll 4 located in the vicinity of the contact element K. Practical tests have proved that the counting accuracy is improved if said pressing roll 4 is slightly displaced as opposed to precisely facing the contact element K. Obviously the drive means diagrammatically shown in FIG. 4 is only to be looked upon as a particularly simple solution from among the numerous possible solutions. Particularly when moving the contact means K on an e.g. circular, open or closed path (cf. FIGS. 3A and 3B), it is conceivable to arrange the contact means on the circumference of a fixed, rotary wheel, which is moved by a drive coupled to the wheel spindle. All the drive means must obviously permit an operation of the counting mechanism coinciding with the basic process.

Figure 5A:
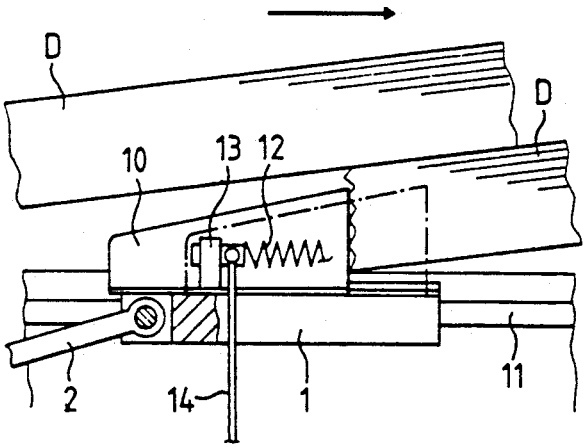
FIGS. 5A and 5B are side and end elevations, respectively, of a first apparatus for performing the process.
Figure 5B:
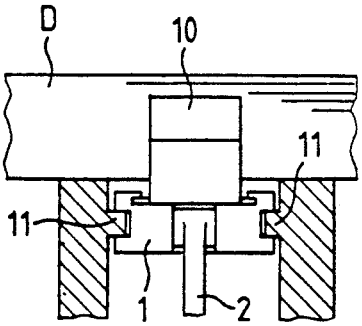

FIG. 5A shows an inventive counting mechanism in a section along the conveying direction (indicated by an arrow), while FIG. 5B shows the same mechanism from the rear in a section at right angles to the conveying direction. The contact element is constructed as a wedge-shaped shell 10 and is displaceably mounted on the slide 1. When the contact element encounters the rear edge of a printed product D, the contact element is displaced in a direction opposite to the conveying direction relative to slide 1 counter to the tension of a return spring 12. FIG. 5A indicates in broken line form the normal position of the contact element 10 and in continuous line form the contact element displaced on the slide. As a result of the displacement of the contact element, a microswitch 13 is operated, whose signal is passed via a cable 14 to a not shown counter, where it is recorded.

FIG. 5B shows how the slide 1 is mounted on the rails 11 positioned below the conveying means, while the wedge 10 projects into the plane of the printed product D. The conveying means for the printed products can e.g. comprise two, not shown, parallel conveyor belts, so that the counting mechanism can be located in the gap between them.

Figure 6A:
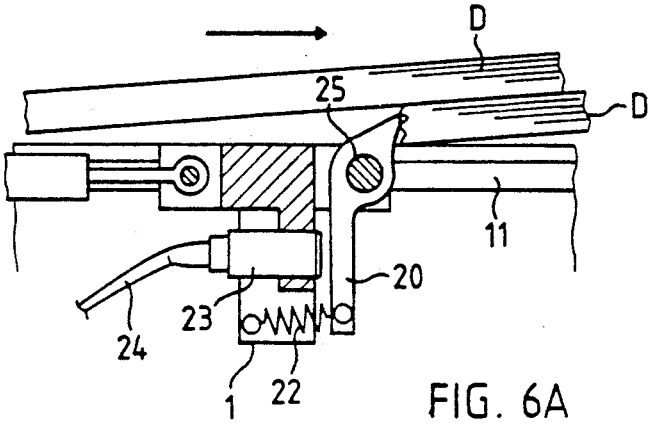
FIGS. 6A and 6B are side elevations of a second apparatus for performing the process.
Figure 6B:
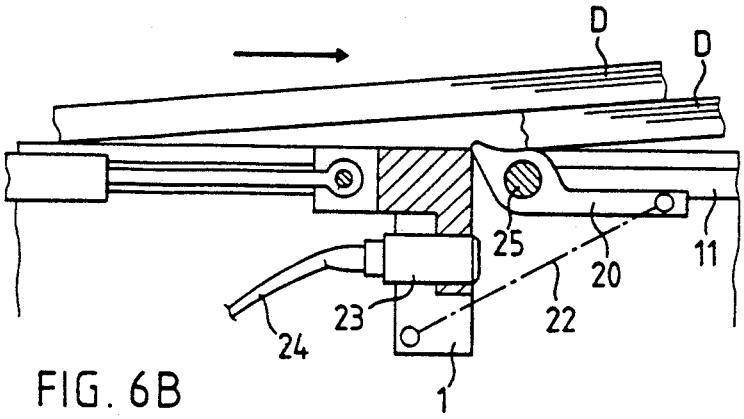

FIGS. 6A and 6B show another construction of the inventive mechanism, in which the contact element is constructed as a latch 20 mounted so as to rotate about an axis or spindle 25 on the slide 1. This construction has the particular advantage that there is no risk of the printed products being moved by the contact element out of their positions in the scale flow. The latch 20 shown in FIG. 6A at the instant of the first contact with the printed product D is, during the further advance of the slide 1 relative to the printed product, deflected to such an extent by the latter that the printed product is able to slide away above it without any displacement (FIG. 6B). The deflected latch 20 is drawn back into the inoperative position by a return spring 22.

Although in principle a microswitch arrangement as in FIG. 5 would be possible, in this construction the deflection of the latch is recorded by a light barrier arrangement. A light beam emitted by an optical transmitter-receiver element 23 is reflected by the latch 20, when the latter is in the inoperative position (FIG. 6A), but when the latch is deflected, reflection of the light beam is prevented and is passed as a counting pulse via a cable 24 to a not shown counter. Obviously the detector 23 can also be constructed as a passive, photosensitive element, which reacts to the instant light with the latch deflected.

Figure 7A:
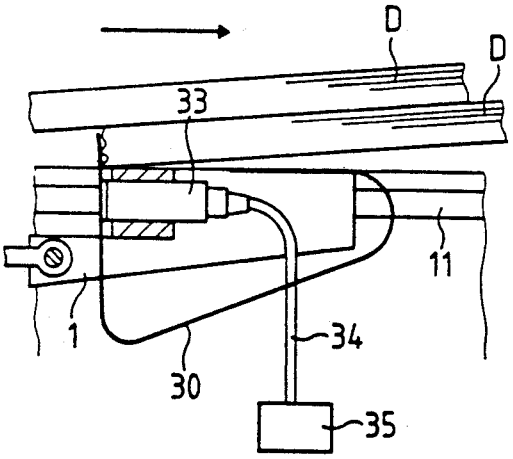
FIGS. 7A and 7B are side elevations of a further apparatus for performing the process.
Figure 7B:
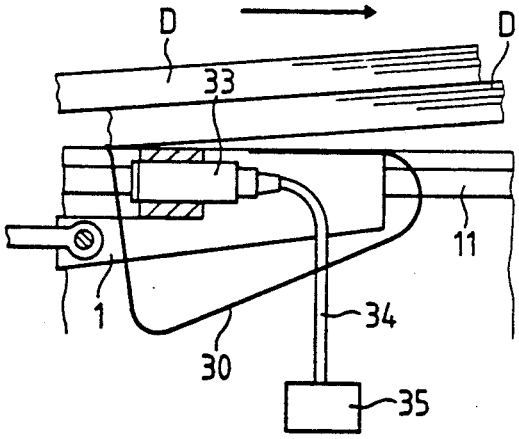

In another construction of the inventive apparatus the contact element is constructed as a resilient clip 30. This construction also has the advantage that the clip is deflected from its inoperative position (FIG. 7A) by the printed product D to be detected to such an extent that it cannot interfere with the product flow (FIG. 7B). As a further variant the contact between the clip 30 and the printed product D is recorded in that a magnetic circuit between the clip 30 and the detector 33 is temporarily interrupted by the clip deflection and then a corresponding counting pulse is passed via a cable 34 to a counter 35. The counter 35 is only diagrammatically indicated and it can be a local, e.g. electromechanical or electronic counter, or a central counter, particularly a computer control.

The aforementioned variations of the inventive apparatus merely constitute preferred embodiments thereof and the invention is obviously not restricted thereto. In particular in the preceding drawings the preferred construction is shown with a counting mechanism located below the scale flow. Although this corresponds to the preferred arrangement, because as a result the trailing edges to be detected rest on the conveying means and consequently have a clearly defined height, it also falls within the scope of the invention to position the counting mechanism above the scale flow, e.g. if in a specific case said flow is formed by rearwardly overlapping printed products. It is also possible for the purpose of increasing accuracy, to bring about a double detection of each printed product, in that the movement of the contact element takes place with a correspondingly increased speed $v_2$. It is obvious that as a result of the multiple arrangement of said apparatuses at a given point of the product process and the corresponding coupling thereof with a common counter either the accuracy can be increased by redundancy or the operating frequency of the individual mechanism can be reduced.

Although normally printed products are conveyed as a scale flow, it is obviously also possible to use the inventive process in other cases. The inventive process can also detect printed products conveyed in irregular time intervals, in that e.g. a further element (e.g. a simple light barrier) carries out a rough detection of the printed products and correspondingly activates the inventive contact element at irregular time intervals.

I claim:

1. A process for producing counting pulses representative of printed products being conveyed along a path past a counting location comprising the steps of moving the printed products (D) past the counting location at a speed $v_1$;

moving a contact element (K) along the path in the direction of motion of the conveyed printed products (D) from a starting position at a speed $v_2$ which at least in part is greater than the speed $v_1$ of the products;

contacting the trailing edge of a product with the contact element as the product is being conveyed;

producing a counting pulse in response to the contact between the contact element and the product;

moving the contact element back to the starting position; and repeating the foregoing steps.

2. A process according to claim 1 wherein the repetition interval of the motion of the contact element is a function of the time interval (T) between the passage of two successive printed products ($D_k$, $D_{k+1}$).

3. A process according to claim 2 wherein the step of moving the contact element includes, during the average time interval (T) between the passage of two successive printed products ($D_k$, $D_{k+1}$), advancing the contact element by a predetermined distance (H) from the starting position substantially linearly and parallel to the direction of motion of the printed products and returning the contact element to its starting position after contacting a product.

4. A process according to claim 3 wherein the predetermined distance (H) is at least as great as the sum of half of the average spacing (S/2) between two successive printed products ($D_k$, $D_{k+1}$) plus twice the statistical standard deviation ($2\Delta S$) of a printed product from a central position thereof.

5. A process according to claim 4 wherein the average speed $v_2$ of the contact element (K) through the movement away from and to the starting position over the predetermined distance (H) is at least as great as the product of the conveying speed ($v_1$) of the printed product and the term $(1+4\Delta S/S)$ wherein S is the average distance between two successive printed products ($D_k$, $D_{k+1}$) and $\Delta S$ is the statistical standard deviation of the printed products from their central positions.

6. A process according to claim 3 wherein the predetermined distance (H) is substantially equal to the average distance (S) between two successive printed products ($D_k$, $D_{k+1}$) and wherein the average speed $v_2$ of the contact element is substantially equal to twice the conveying speed $v_1$.

7. A process according to claim 1 wherein the step of moving the contact element from its starting position and back to its starting position takes place along a closed path during the average time interval (T) between the passage of two successive printed products.

8. A process according to claim 1 and including moving a plurality of contact elements (K) along a closed path in a time interval substantially equal to the average time interval between two successive printed products passing a fixed point.

9. An apparatus for counting printed products as the products are moved along a path past a counting location at a predetermined speed comprising the combination of guide means adjacent said path;

a contact element movable along said guide means in the direction of motion of said printed products along said path;

drive means for moving said contact element along said guide means in said direction of motion at a speed greater than said predetermined speed of said printed products so that said contact element contacts an edge of a printed product;

means operatively associated with said contact element for producing an output signal in response to said contact of said contact element with said product edge;

means for counting output signals; and means for conducting said output signals to said means for counting.

10. An apparatus according to claim 9 wherein said guide means is positioned below said path.

11. An apparatus according to claim 9 wherein said guide means forms a substantially straight guide path extending parallel with the path of motion of said products.

12. An apparatus according to claim 11 wherein said guide means includes two parallel rails.

13. An apparatus according to claim 11 and further including a body slidably mounted on said guide means, said contact element being mounted on and movable with said body.

14. An apparatus according to claim 9 and further including a body slidably mounted on said guide means, said contact element being mounted on and movable with said body.

15. An apparatus according to claim 14 wherein said drive means includes a crank drive, said body being coupled to said crank drive for movement in the direction of motion of said products from a starting position a predetermined distance and back to said starting position.

16. An apparatus according to claim 14 and including means for mounting said contact element on said body for movement relative to said body between a first position and a second position and a spring urging said contact element toward said first position, and wherein contact of said element with a product moves said contact element toward said second position against the urging of said spring in a direction counter to the direction of product motion relative to said body.

17. An apparatus according to claim 16 wherein said means operatively associated with said contact element for producing an output signal comprises a microswitch the state of which is switched by movement of said contact element from said first position toward said second position.

18. An apparatus according to claim 16 wherein said means operatively associated with said contact element for producing an output signal comprises an optical sensor the state of which is switched by movement of said contact element from said first position toward said second position.

19. An apparatus according to claim 14 wherein said contact element comprises a latch and a pivot pin for pivotally mounting said latch on said body, said latch having a portion contactable by a product to pivot said latch from an inoperative position to an operative position in which an output signal is produced, said pivot pin extending substantially perpendicular to the direction of product motion.

20. An apparatus according to claim 19 wherein said means operatively associated with said contact element for producing an output signal comprises an optical sensor the state of which is switched by movement of said latch from said inoperative to said operative position.

21. An apparatus according to claim 14 wherein said contact element comprises a clip mounted on said body for deflection from an inoperative position to an operative position by contact with said product.

22. An apparatus according to claim 21 wherein said means operatively associated with said contact element for producing an output signal comprises a magnetic circuit the state of which is changed by movement of said clip from said inoperative to said operative position to produce said output signal.

23. An apparatus according to claim 14 and including a stabilizing device adjacent said counting location acting on said printed products to stabilize flow thereof, said stabilizing device being located on the opposite side of said path from said contact element.

24. An apparatus according to claim 9 and including a stabilizing device adjacent said counting location acting on said printed products to stabilize flow thereof, said stabilizing device being located on the opposite side of said path from said contact element.

* * * * *